United States Patent [19]

Turner

[11] 4,230,538

[45] Oct. 28, 1980

[54] STRIP LINE PLATING CELL

[75] Inventor: Dennis R. Turner, Chatham Township, Morris County, N.J.

[73] Assignee: Bell Telephone Laboratories, Incorporated, Murray Hill, N.J.

[21] Appl. No.: 92,380

[22] Filed: Nov. 8, 1979

[51] Int. Cl.[3] ..... C25D 5/02; C25D 17/12; C25D 17/28

[52] U.S. Cl. ..... 204/15; 204/28; 204/224 R; 204/207

[58] Field of Search ..... 204/15, 224 R, 28, 129.6, 204/206, 207

[56] References Cited

U.S. PATENT DOCUMENTS

| | | | |
|---|---|---|---|
| 4,029,555 | 6/1977 | Tezuka | 204/15 |
| 4,153,523 | 5/1979 | Koontz | 204/129.6 |

*Primary Examiner*—T. M. Tufariello

*Attorney, Agent, or Firm*—Walter G. Nilsen

[57] ABSTRACT

A gold plating cell and process are described which are particularly useful for continuous gold plating procedures. Advantages of the use of this gold plating cell is the rapid plating possible without degradation of the quality of the plated gold. Rapid plating is desirable economically because of greater product throughput. Also, the cell and process is such as to concentrate the gold plating in areas of the strip where it is most needed. This is also economically advantageous since it reduces the amount of gold used.

17 Claims, 13 Drawing Figures

STRIP LINE PLATING CELL

TECHNICAL FIELD

The invention involves a gold electroplating procedure and apparatus.

BACKGROUND OF THE INVENTION

Electrochemical processing procedures are extensively used in modern technology particularly in circuit fabrication and manufacture of electrical devices such as connectors, relay contacts, switch contacts, etc. Bulk processing procedures are often used and usually yield perfectly good results. It is desirable to improve these procedures in various ways. More rapid processing is highly desirable economically, particularly for high volume items such as connector contacts, relay contacts, circuit boards, etc. More exact control of the electrochemical process is advantageous so as to reduce the number of rejected components, improve plating quality and to insure high reliability and long life. It is also advantageous economically to reduce the volume of plating solution required, to reduce the volume of rinse water needed in the plating process, and to reduce the volume of air that must be vented for environmental purposes.

These considerations are especially true for gold electroplating procedures and apparatus used to make high-volume items like pins for electrical connectors. Also, high reliability is important and reduced usage of gold can lead to large economic savings. Other similar cells and processes have been described in U.S. Pat. No. 4,153,523.

SUMMARY OF THE INVENTION

The invention is a gold plating cell and process particularly useful for incorporation in a continuous strip plater. The cell includes a curved anode which runs the length of the cell. The curved anode serves a two-fold purpose in concentrating gold plating in the area of the strip where desired. Firstly, the outer edge of the curved anode is located closest to where gold plating is desired. This insures that electrolyte resistance is lowest to that part of the strip where plating is desired. Secondly, the curved anode directs the gold plating solution onto the part of the metal strip where gold plating is required. The anode is shaped in such a way as to insure high flow rates in the area being gold plated.

In addition, the curve of the anode is approximately the same as the electrolyte conduit just below it so that the electrolyte pouring out from between anode and conduit continues in a curved are close to the conduit. This insures that the electrolyte has very high flow rates close to the conduit where the strip being plated is located. Also, a series of grooves or lateral slots are located on the conduit surface to where the part of the strip being plated is located. These lateral slots run the length of the electrolyte conduit. These lateral slots greatly increase turbulance flow in the region where plating is desired. This turbulant flow makes it possible to use high plating rates without degrading plating quality. The cell may be incorporated in a continuous gold plating apparatus, generally made up of a succession of processing cells, including cleaning cells, electroplating cells, rinse cells, etc. These cells are located successively along a processing line. Processing takes place as the continuous metallic strip moves down the strip plating machine. Design of the electroplating cell and other processing cells in the strip line are such so as to insure compatibility with other chemical steps in the continuous electrochemical process. The gold electroplating cell has provision for guiding the metal strip down the center of the structure and an anode (e.g., platinum or platinum coated metal such as platinized titanium) which runs the length of the cell. Proximity of the anode to the area of the strip to be plated and to the flowing electroplating solution insures that most of the gold plating occurs on the part of the strip where it is desired. Typically, for electrical connector terminal pins, gold is concentrated on the part of the strip line that becomes the electrical contact points in the electrical connector. This apparatus and the process of using this apparatus insures efficient use of gold as well as rapid gold plating with excellent gold plate characteristics. For many applications, including the manufacture of electrical contact pins (relay contacts, connector pins, etc.), the strip is made of a metal, preferably a good electrical conducting metal, as for example, a metal containing at least 50 weight percent copper. A particularly good metal for electrical connectors contains 8 to 9 weight percent nickel, 1.5 to 2.5 weight percent tin, remainder copper.

Although various gold plating solutions are useful in this apparatus and process, one particular composition is especially suitable because it permits rapid plating with excellent plating results. The plating composition comprises 16–20 gm/1 gold as $KAu(CN)_2$, 65–86 parts per million cobalt usually added as cobalt citrate and a citrate buffering system with the pH of the solution generally in the range from 3 to 6, preferably $4\pm0.2$. The buffering system is conveniently made by adding 100 gm/1 citric acid and 50 gm/1 KOH to the electroplating solution. The gold electroplating cell may be followed by a blow-off section and often by a rinse cell. Typically, other cells proceed and follow the gold electroplating cell which carry out various electrochemical procedures such as cleaning, electropolishing, etc. One typical arrangement has first a nickel plating cell, then a flash soft gold plating cell and then the hard gold plating cell. Multiple cells such as two identical gold plating cells may be used to increase effective plating rate. This often permits increased throughput of the strip plating line. These various cells may have blow-off sections and rinse cells interposed at various locations along the strip plating line to minimize contamination between cells.

DETAILED DESCRIPTION

Figure 1:
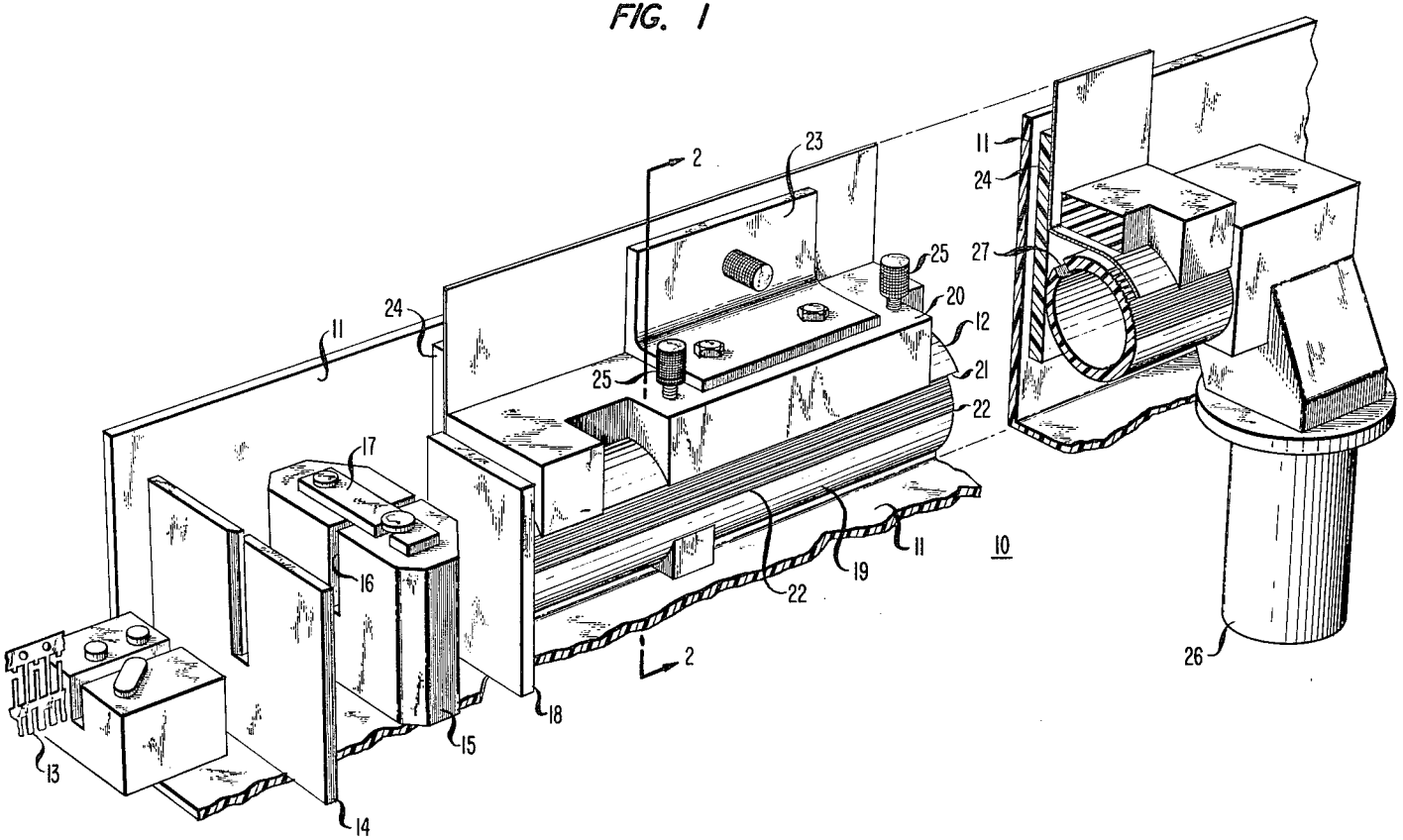
FIG. 1 shows a perspective view in section of the electroplating cell.

The plating cell is arranged so that a fine stream of plating solution impinges onto a small area of strip as it moves down the plating cell. This fine stream of plating solution exits between anode and electrolyte conduit along the length of the cell. The stream of electrolyte tends to follow the contour of the conduit and is broken up by the lateral slots. This creates high turbulance and flow rates in the area of the strip where plating is desired. It is this small area of the strip that receives most of the gold plating. Generally, where connector terminal pins or electrical contacts are made, the gold is concentrated in the area where electrical contact is made.

An essential feature of the invention is that the anode electrode is used both to shape and concentrate the electrolyte stream onto the area where plating is desired and to concentrate the plating current (electric field lines) to the area of the strip where plating is desired. This two-fold feature of the anode electrode together with the rapid flow of electrolyte around the area being plated results in rapid plating, with good quality and plating concentrated in the area of the work piece where plating is desired.

An understanding of the invention is conveniently obtained by a description of the drawing.

FIG. 1 shows a perspective, sectioned view of a gold plating cell 10 comprising container 11 and various elements located in and around the container. The container may have a variety of shapes and is used to collect electrolyte that sprays out from under the anode 12 and onto the work being plated (the strip 13). Generally, the container is in the form of a long narrow trough with a tube at the bottom to return electrolyte to the reservoir and pump station usually located below the plating cell.

The active elements of the gold plating cell are located in the container 11. In describing these elements, it is useful to follow the strip from where it enters the interior of the container down to where it exits the container. First, the strip 13 passes through a slotted section 14 so as to enter the container 11. This slotted section confines the plating bath or electrolyte to the container and prevents bath from spilling out of the container 11. The slotted section is usually high enough so that it fits against a cover to prevent splash over of the electroplating bath.

The strip then passes through a second slotted section 15, perhaps better called a strip guiding section 15. This section is used to align the strip against the part of the apparatus where plating takes place. The strip guiding section has a slit 16 generally just wide enough to fit the strip through. The strip rides on a slipping device (usually a wheel) so as to reduce friction. The strip is held down by a bar 17 over the top of the slit so as to prevent the strip from riding up.

The strip line next passes by a rectangular flat section 18 which both guides the strip and is the end-piece of the electrolyte conduit 19. The strip is guided in such a way that it lies against a flat wall of the electrode positioning mounting member 20. The part of the strip to be plated (finger portion near bottom) is positioned near the front edge 21 of the anode electrode 12 and the notched or laterally slotted part 22 of the electrolyte conduit 19. These lateral slots 22 increase turbulance in the flow of electrolyte near the part of the strip where plating is desired. The electrode positioning mounting member 20 and anode electrode 12 are held in place by mounting brackets 23 which are attached (usually by means of a screw) to a mounting wall 24. Often the electrical connection to the anode electrode 12 is made by attaching a wire to a screw on the mounting bracket 23.

Screw (called here "anode set screws") 25 threaded through the electrode positioning mounting member 20 are used to position the anode electrode relative to the electrolyte conduit 19. Electrolyte enters the plating cell under pressure through a tube (electrolyte filling tube) 26 and is directed along the inside of the electrolyte conduit. The electrolyte exits the electrolyte conduit through a slit 27 in the back of the conduit that runs essentially the length of the conduit. Electrolyte flows onto the anode electrode and then in the space between electrode and the outside of the electrolyte conduit. It pours out (usually with considerable force) from between anode and conduit and onto the strip being plated. Electrolyte is prevented from flowing back between conduit 19 and mounting wall 24 by a seal (usually a glue joint) between conduit and wall. Adjustment of the anode electrode position by means of the screws 25 (anode set screws) not only changes the position of the anode relative to the conduit, but also changes the position and character (flow, force, spread, etc.) of the stream of electrolyte impinging onto the strip being plated.

Figure 2:
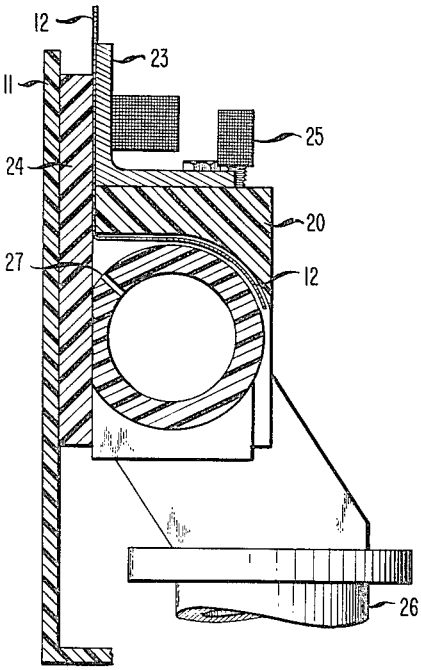
FIG. 2 shows an end view of the electroplating cell.

FIG. 2 shows a section view, perpendicular to the long length of the cell and through approximately the middle of the cell. The electrolyte filling tube 26 is seen as well as the mounting wall 24. The mounting bracket 23 is used to mount both the anode electrode 12 and electrode positioning mounting member 20 to the mounting wall 24. The anode set screws 25 are shown as the pass through the electrode positioning mounting member and impinge onto the anode 12. Varying the depth of this screw changes the spacing between anode and conduit which in turn changes the direction and spread of electrolyte running out from between anode and conduit. Toward the back top of the conduit is the slit 27. Electrolyte runs out of the conduit through this slit and between the outside of the conduit and the anode electrode.

Figure 3:
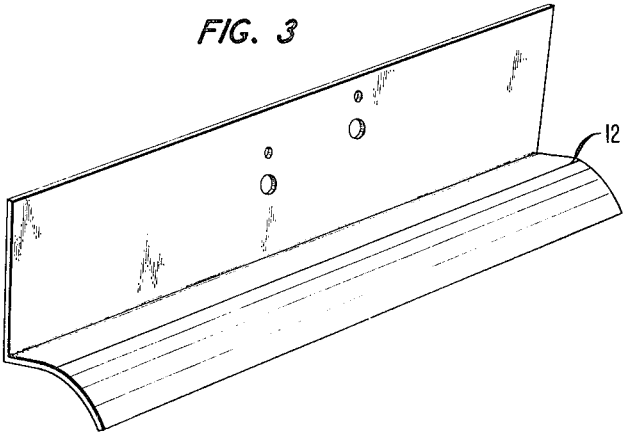
FIG. 3 shows a perspective view of the anode of the electroplating cell.

FIG. 3 shows the anode electrode 12 with one portion contoured to conform to the shape of the electrolyte conduit and the other portion flat to conform to the mounting wall.

The strip plating apparatus may include more than one electroplating cell, particularly if the gold plating procedure is limiting the speed at which the strip goes through the apparatus.

Figure 4:
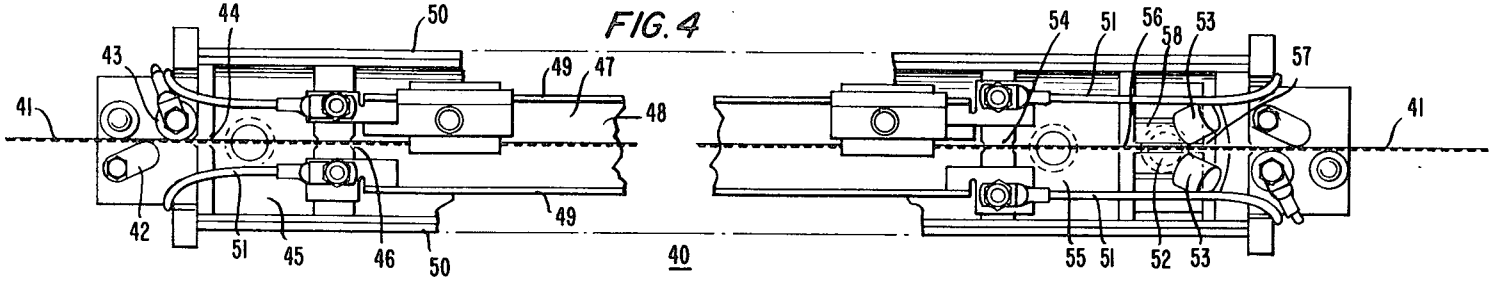
FIG. 4 shows a top view of the electropolishing cell.

FIG. 4 shows a top view of the electropolishing cell 40 comprising generally a long narrow container with metallic strip 41 entering the electropolishing cell through an electrical contact 42 and 43. The electrical contact arrangement comprising a stationary member 42 which is pressed up against the strip and a member 43 with a roller. This electrical contact arrangement is used to pass current between metal strip and one polarity of a power supply. Generally, the entire metal strip is kept at the same potential (often ground potential)

and the electrodes biased either positive or negative for electropolishing or electroplating.

The strip then passes through a small narrow slotted section 44 into a small spill-over chamber 45, then through another small narrow slotted section 46 and into the main part of the electropolishing cell 47 containing the place for electropolishing solution 48 and electrodes 49. These electrodes are in the form of long flat plates extending over most of the length of the cell and parallel to both the strip and cell walls 50. Wires 51 are used to carry electrical energy from power supply to the electrodes. The strip exits the main part of the electropolishing cell through a small narrow slot 54 into a spill-over chamber 55. The metal strip exits the spill-over chamber 55 through another small narrow slot 56. A blow-off section 52 is used to blow off most of the electroplating solution from the strip prior to leaving the cell. Two nozzles 53 are used to direct a gaseous stream (usually air) onto the strip 41 so as to remove electrolyte solution. The metal strip exits through a small opening 57 in the blow-off section and then to subsequent processing cells.

Figure 5:
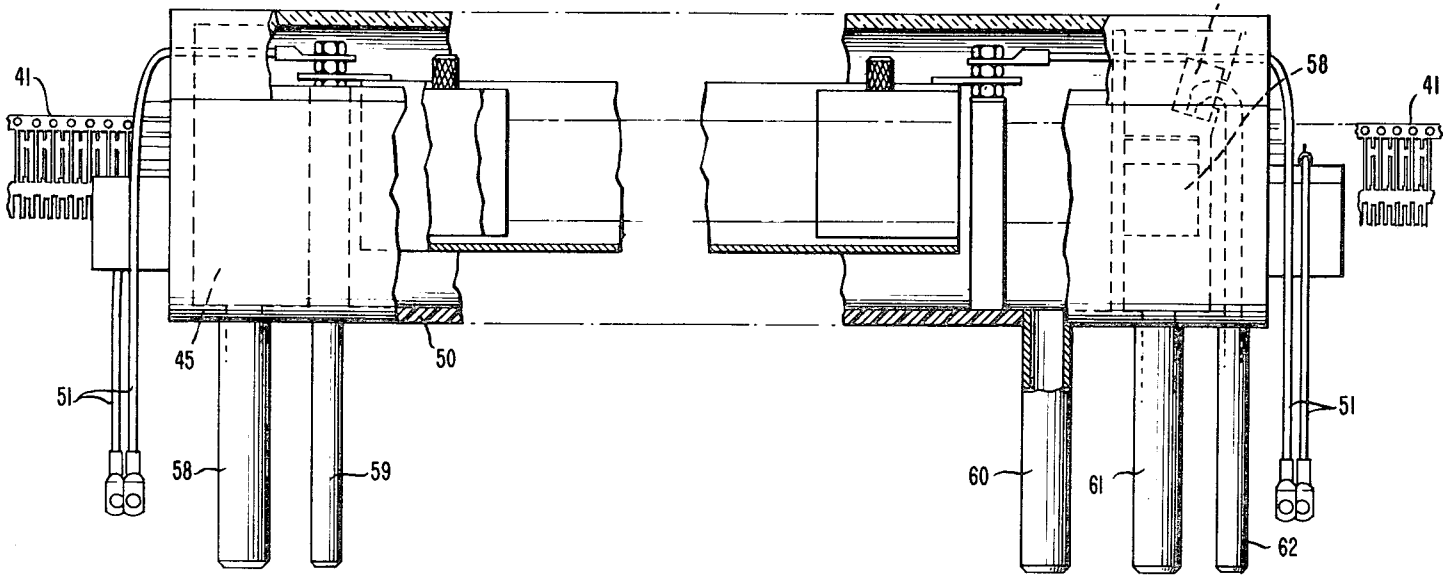
FIG. 5 shows a side view of the electropolishing cell.

FIG. 5 shows a side view of the electropolishing cell 40 showing metal strip 41 and drain-off or exit tube 58 from the spill-over chamber 45 and wires 51 used to carry current to the electrodes 49. The entrance tube 59 for the electropolishing solution is also shown together with electrode 49 and cell wall 50. Also shown is the exit tube 60 for the spill-over chamber 55 and the exit tube 61 for the blow-off chamber 52. The exit tubes (58, 60, 61) convey electropolishing solution to a reservoir from which it is recirculated by pumping electropolishing solution up through the entrance tube 59. The tube 62 is used to convey gas (usually air) for the blow-off nozzle 53.

Figure 6:
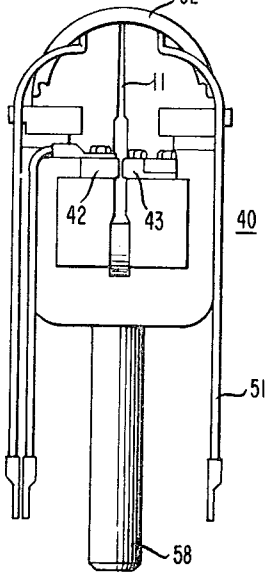
FIG. 6 shows an end view of the entrance end of the electropolishing cell.

FIG. 6 shows an end view of the entrance end of the polishing cell with electrical wires 51 and exit tube 58. Also shown are electrical contacts 42 and 43 and cell cover 62.

Figure 7:
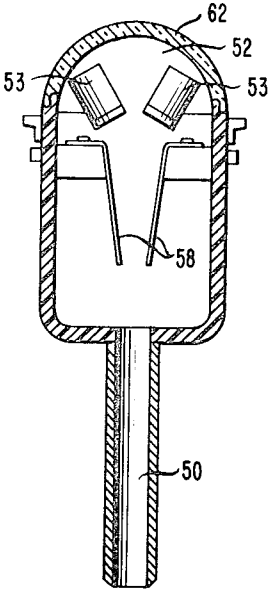
FIG. 7 shows an end view of the blow-off section following the electropolishing cell.

FIG. 7 shows an end view of the blow-off section with blow-off nozzles 53 and deflecting blades 58 used to concentrate the air stream on the metal strip. Also shown is the exit tube 60 and cell cover 62.

Figure 8:
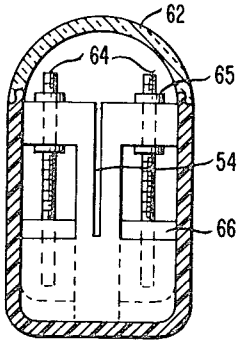
FIG. 8 shows an end view (exit end) of the electropolishing cell including a view of the damming arrangement used to fix the level of electrochemical solution.

FIG. 8 shows an end view of the main part of the electropolishing cell. It includes a small narrow slot 54 through which the metal strip 41 moves. Also shown is a damming device with screws 64, lock nuts 65 and dam 66. The height of this dam controls the level of electropolishing solution in the main part of the electropolishing cell. Electropolishing solution spills over the dam and is returned to a reservoir from which it is subsequently recirculated by pump.

Figure 9:
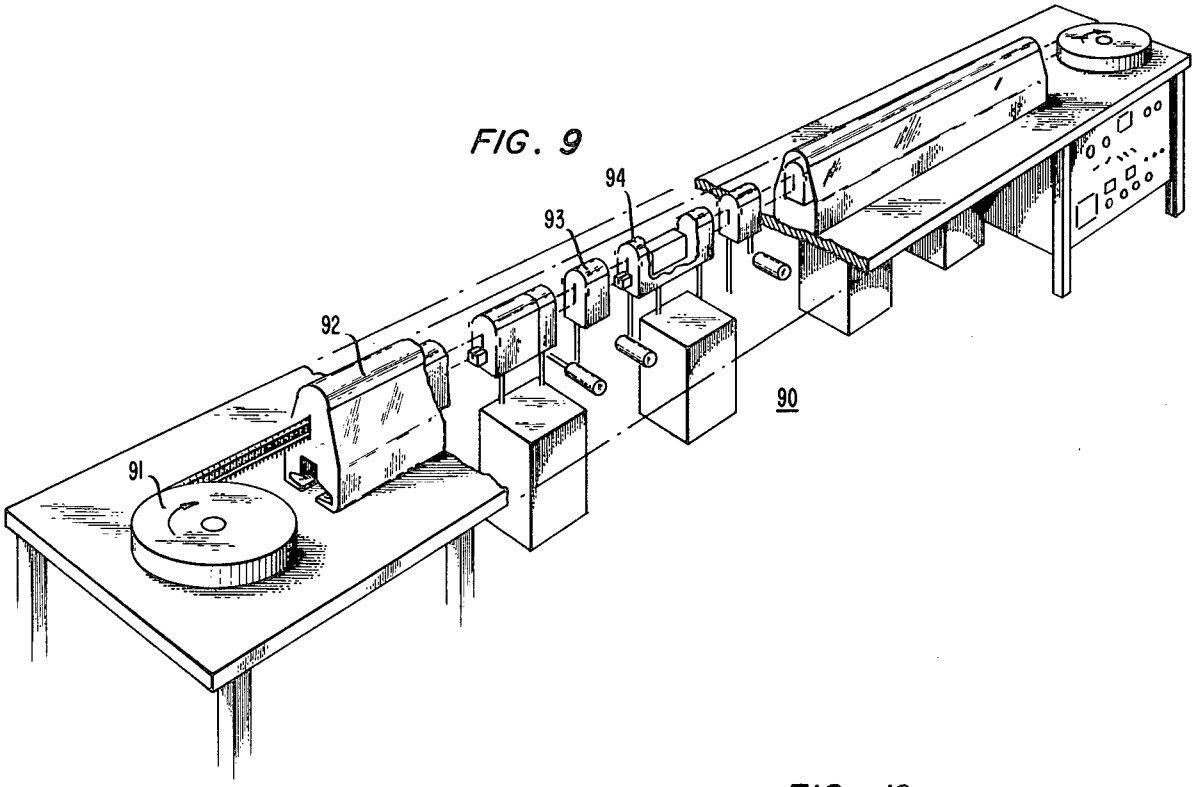
FIG. 9 shows a perspective view of the strip plating machine.

FIG. 9 shows a perspective view of a strip plating machine 90 with a spool of metal strip 91 which is fed into electropolishing cell 92. Also shown are rinse cells 93 and various plating cells 94.

Figure 10:
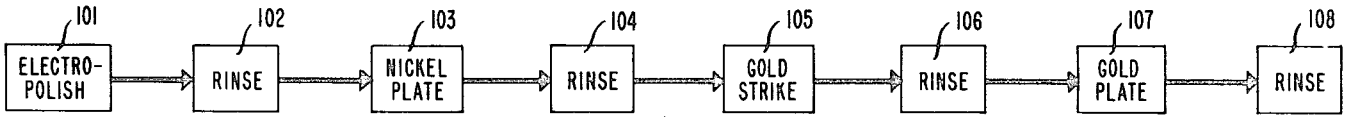
FIG. 10 shows a block diagram of the strip plating machine.

FIG. 10 shows in block diagram 100 a typical strip line processing apparatus with electropolishing cell 101, rinse cell 102, nickel plating cell 103, rinse cell 104, gold strike cell 105, rinse cell 106, gold plate cell 107, and rinse cell 108.

Figure 11:
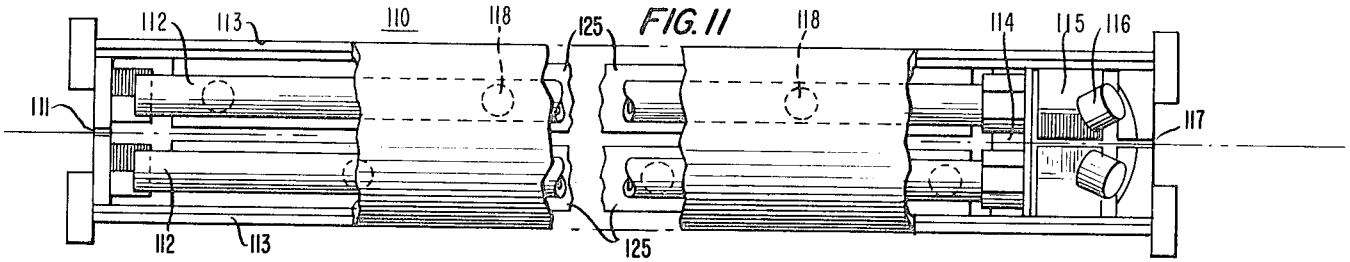
FIG. 11 shows a top view of a rinse cell.

FIG. 11 shows a top view of a rinse cell 110 showing a small narrow slot 111 through which the metal strip enters the rinse cell. Rinsing is provided by a spray of preferably hot water from nozzles 118 attached to tubes 112 running parallel to the cell walls 113. The nozzles 118 are pointed downward toward the metal strips. Although tubes and nozzles may be made of many suitable materials, titanium is preferred for the tube because of rigidity and chemical inertness and chloropolyvinylchloride for the nozzles because of chemical inertness. Parallel walls 125 on either side of the metal strip and dsiplaced parallel to the metal strip are used to concentrate the water spray on the metal strip. The metal strip exits through a small narrow slot into a blow-off section 115 with two nozzles 116 used to direct a gaseous stream (usually air) into the strip. The metal strip then exits through a small slot 117.

Figure 12:
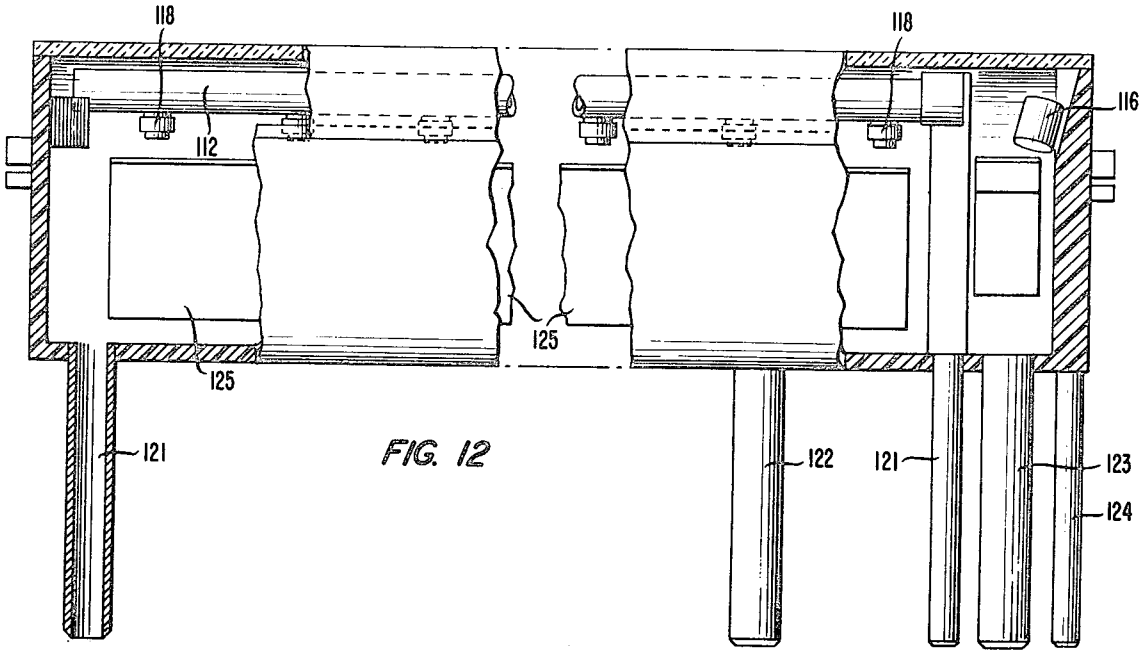
FIG. 12 shows a side view of a rinse cell.

FIG. 12 shows a side view of a rinse cell 110, shown are the tubes for the water spray 112 and nozzle 116 used for the air spray. Also shown is the water inlet tube 121, water exit tubes 112 and 122 air inlet tube 124 and air-water exit tube 123.

Figure 13:
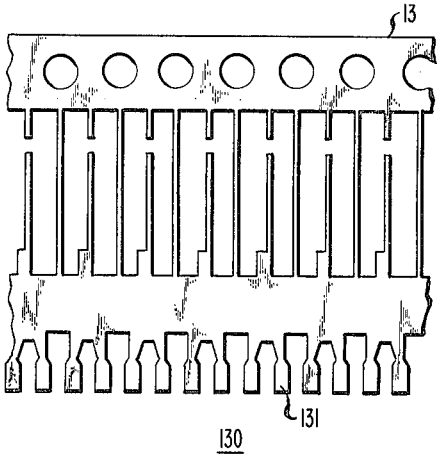
FIG. 13 shows a strip line of connector pins advantageously plated in accordance with the invention.

FIG. 13 shows a portion of the metal strip 130 used to make connector pins. Plating is concentrated on one side of the finger sections 131 which become the contact areas after the pins are separated, bent into shape and put into the connector.

Highly advantageous is a process for making electrical connectors from pins made on the apparatus described above. Pins are required to be exposed to a variety of electrochemical processes including cleaning, electropolishing, different electroplating procedures, such as nickel plating, flash gold plating, hard gold plating, etc. In addition, continuous strips (unpunched) may also be processed. Particularly advantageous is immediate sequential processing since surfaces are not contaminated between processing steps and large amounts of inventory need not be built up between processing steps. Further, pins are rapidly produced with high yield and low cost. Process control is exceptionally good because the rapid recirculating bath solutions can be temperature stabilized easily and rapidly analyzed to insure good compositional control. The process is particularly convenient for real time control, including pH measurement, temperature control, etc. as processing is carried out. It permits many economic advantages such as high speed processing, reduced labor, reduced inventory of chemicals, reduced venting costs, time-shared processing control, common support systems for all processing steps and flexibility in exchanging processing cells for improved processing or adding additional processing steps.

What is claimed is:

1. An apparatus for continuous gold electroplating a strip including a gold plating cell, said gold plating cell comprising a container containing plating elements CHARACTERIZED IN THAT the plating elements comprise (a) means of conveying electrolyte from a reservoir to an electrolyte conduit, said electrolyte conduit having a passageway opening in the upper rear of the passageway;

(b) a mounting wall joined to the rear of the conduit;

(c) an anode electrode with a first portion contoured to conform to shape of conduit spaced from and extended over the conduit, the contoured portion serving simultaneously to direct the flow of the electrolyte exiting from the passageway of the conduit and to perform the electrochemical function of the anode; and (d) an electrode positioning mounting member mounted above the contoured portion of the anode electrode, the electrode positioning mounting member including means for deflecting the contoured portion of the anode electrode to control the direction of flow of the electrolyte.

2. The apparatus of claim 1 in which a second portion of the anode electrode has a flat shape and is attached to the mounting wall by means of mounting bracket which also holds the electrode positioning mounting member in place.

3. The apparatus of claim 1 in which the plating elements further comprise a means for guiding and positioning the strip being plated.

4. The apparatus of claim 3 in which the means for guiding and positioning the strip is a strip guiding section comprising a slot wide enough to accomodate the strip and high enough to accomodate the strip with the strip held down by a bar over the slit.

5. The apparatus of claim 1 in which the plating elements further comprise a slotted wall, the slot of sufficient depth and width to admit the strip and the wall located at the ends of the container to prevent electrolyte from spilling out of the container.

6. The apparatus of claim 1 in which a plurality of sets of plating elements are in series.

7. The apparatus of claim 1 which further comprises means for making electrical contact to the strip.

8. The apparatus of claim 7 in which the means for making electrical contact to the strip comprises a stationary rectangular member rounded-off at the end and pressing against the metal strip line and two stationary round members located on the other side of the strip line and located before and after the staionary rectangular member, said rectangular and round members made of conducting material.

9. The apparatus of claim 1 in which the strip comprises at least 50 percent by weight copper.

10. The apparatus of claim 9 in which the strip consists essentially of 8 to 9 weight percent nickel, 1.5 to 2.5 weight percent tin, remainder copper.

11. The apparatus of claim 1 in which the gold plating cell is followed by a blow-off section with two gas nozzles located approximately symmetric on each side of the space provided for the strip said blow-off section provided with a drainage tube to convey electrolyte solution to a reservoir and passageways to convey gas to the gas nozzles said blow-off section equipped with deflection plates, one on each side and approximately parallel to the strip along its length and inclined inward toward the metal strip as the deflection plate extends downward.

12. The apparatus of claim 1 in which the gold plating cell is followed by a rinse cell.

13. The apparatus of claim 11 in which the rinse cell comprises (a) an entrance slotted section for admitting the strip into the rinse cell, said entrance slotted section being deep enough to admit at least a portion of the strip into the rinse cell and wide enough to provide clearance for the strip;

(b) two tubes located along the length of the rinse cell and equipped with nozzles so that water sprays towards the place for the strip;

(c) deflection plates located on each side of the strip, parallel to the length of the strip and slightly inclined toward the strip as the deflection plates extend downward so as to concentrate rinse spray onto the strip;

(d) a rinse exit slotted section said rinse exit slotted section being deep enough to admit at least a portion of the strip into the rinse cell and wide enough to provide clearance for the strip; and (e) a blow-off section with gas nozzles used to blow off liquid from the strip.

14. The apparatus of claim 1 which comprises in addition in succession an electropolishing cell, a rinse cell, a nickel plating cell, a rinse cell, a gold strike cell, a rinse cell, a gold plating cell and a rinse cell.

15. The apparatus of claim 1 in which the strip comprises connector pins for an electrical connector.

16. The apparatus of claim 1 in which the electrolyte is laterally slotted close to where the strip is plated.

17. A process for making electrical connectors comprising the step of carrying out a chemical procedure on a strip comprising pins for the electrical connector using an apparatus for continuous gold plating including a gold plating cell, said gold plating cell comprising a container containing plating elements characterized in that the plating elements comprise (a) means of conveying electrolyte from a reservoir to an electrolyte conduit, said electrolyte conduit having a passageway opening in the upper rear of the passageway;

(b) a mounting wall joined to the rear of the conduit;

(c) an anode electrode with a first portion contoured to conform to the shape of conduit spaced from and extended over the conduit, the contoured portion serving simultaneously to direct the flow of the electrolyte exiting from the passageway of the conduit and to perform the electrochemical function of the anode; and (d) an electrode positioning mounting member mounted above the contoured portion of the anode electrode, the electrode positioning mounting member including means for deflecting the contoured portion of the anode electrode to control the direction of flow of the electrolyte.

* * * * *